United States Patent [19]

Julian

[11] Patent Number: 4,941,580

[45] Date of Patent: Jul. 17, 1990

[54] DISPENSING CLOSURE

[75] Inventor: Randall K. Julian, Evansville, Ind.

[73] Assignee: Sunbeam Plastics Corporation, Evansville, Ind.

[21] Appl. No.: 357,092

[22] Filed: May 26, 1989

[51] Int. Cl.[5] ..... B65D 41/32

[52] U.S. Cl. ..... 215/235; 215/225

[58] Field of Search ..... 215/216, 225, 235; 222/153, 548

[56] References Cited

U.S. PATENT DOCUMENTS

| | | | |
|---|---|---|---|
| 3,779,412 | 12/1978 | Kirton | 215/225 |
| 3,877,598 | 4/1975 | Hazard | 215/224 |
| 3,901,400 | 8/1975 | Westfall | 215/221 |
| 3,966,082 | 6/1976 | Hopkins | 220/306 |
| 4,280,631 | 7/1981 | Lohrman | 215/204 |
| 4,513,888 | 4/1985 | Curry | 222/153 |
| 4,632,264 | 12/1986 | Evans | 215/220 |
| 4,709,823 | 12/1987 | Beck | 215/235 |
| 4,776,475 | 11/1988 | La Vange | 215/216 |
| 4,790,447 | 12/1988 | Gach | 215/216 |

*Primary Examiner*—Stephen P. Garbe

*Attorney, Agent, or Firm*—Gifford, Groh, Sprinkle, Patmore and Anderson

[57] ABSTRACT

A dispensing closure having a base ring with means for attachment to a container which permits rotation of the ring without axial movement. A lid is connected to the base ring by a hinge which allows the lid to be swung from a closed position blocking access to a container opening to an open dispensing position. A cam element on the lid effects initial movement of the lid towards an open position when the base ring is rotated. The lid cam element cooperates with a cam surface on the container. A fitment can also be used to attach the closure to a flat can top or to other container configurations. When a fitment is used, the cam surface will be on the fitment rather than the container.

36 Claims, 5 Drawing Sheets

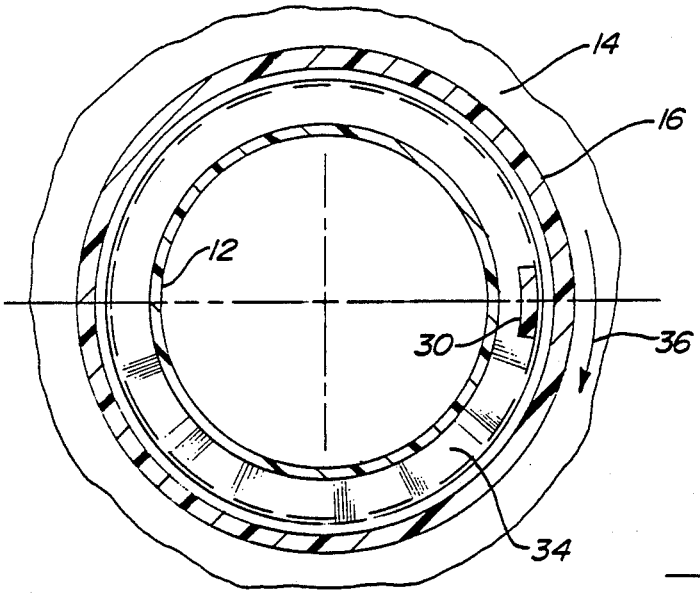
Fig-4
Fig-5
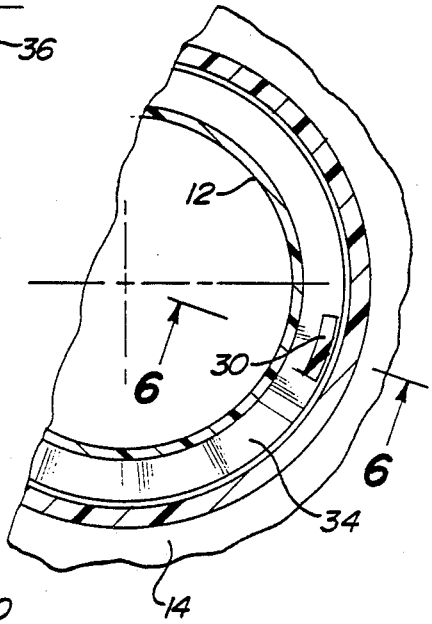
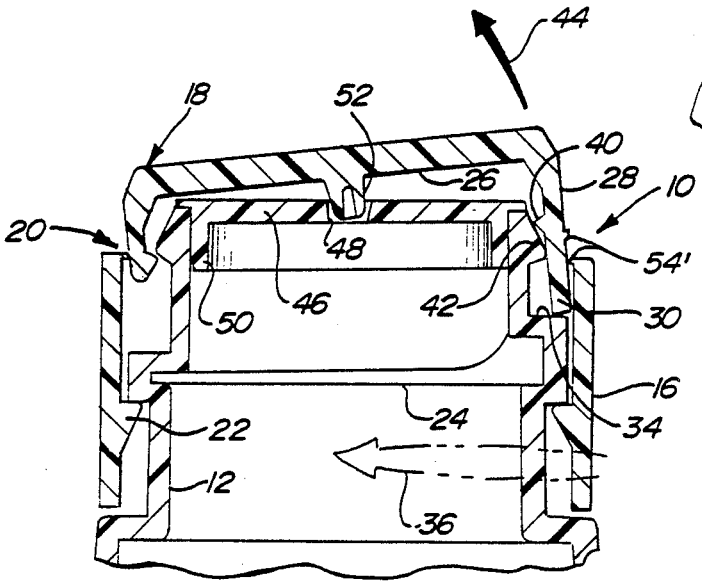
Fig-6

DISPENSING CLOSURE

This invention relates to a dispensing closure for a container having a lid hinged to a base member with the lid swinging from a closed position covering an opening in the container to an open dispensing position, and, more particularly, to means for effecting the initial opening movement of the lid.

Typically a dispensing closure has a base or cap with a cylindrical skirt containing threads or other means such as a snap bead for attachment to a container neck. The cap top usually has a dispensing orifice, and the lid is swung from a closed position covering the orifice to an open position for dispensing a product through the orifice. Normally the lid skirt conforms to or is flush with the cap skirt to present a pleasing appearance, and a finger indentation in the cap skirt provides access for lifting the lid. When the closure is to be child resistant, the finger indentation is eliminated, and a low profile lid is provided which either aligns with the cap skirt or is recessed into the cap top when the lid is in a closed position covering the dispensing orifice. The lid cannot be grasped to exert an opening force without an initial or simultaneous movement or action to expose an edge of the lid so that a second movement can be applied to swing the lid to an open dispensing position. There are a number of aligned or recessed lid child resistant dispensing closures disclosed in the art. In some of the closures, an initial force is applied by finger pressure against the top of the closure. In other closures, an initial finger purchase is obtained by squeezing a portion of the base cap skirt. Various expediencies have been incorporated into these dispensing closures to increase the ease in which the lid edge is exposed for opening, while still retaining the child resistant protection.

The present invention is directed to a closure having a unique arrangement for effecting the initial opening movement of its lid member. With the unique opening arrangement, the closure is adaptable for application to a wide variety of containers including bottle necks and can tops, and the closure can he readily adapted to be child resistant and tamper indicating.

The closure of this invention includes a base ring having means for attachment to a container which permits rotation of the ring without axial movement relative to the container. The closure also includes a lid and a hinge which connects the lid to the base ring allowing the lid to be swung between a closed position blocking access to a container opening and an open dispensing position. A cam element is located on the lid and is so arranged that when the ring is rotated the lid will be moved from its closed position toward its open position by movement of the cam element so that the lid can be swung to its fully open dispensing position.

The cam element on the closure lid engages a cam surface on the container which provides the opening movement of the lid upon rotation of the ring and coaction of the cam element with the cam surface.

The cam surface can take the form of a sawtooth or a vertically undulating surface on a container neck which coacts with the cam element on the lid which can be in the form of a vertically depending cam follower which is lifted by the sawtooth or container undulation as the closure ring is rotated.

The closure ring can have an inwardly directed bead which snaps over a corresponding flange on the container neck to retain the ring on the neck while permitting relative rotation between the ring and the container neck.

In the case of a container in the form of a can, a fitment can be provided which snaps into an opening in the top of the can and onto which the closure ring can be snapped for relative rotation. The cam surface which cooperates with the lid cam element would be formed in the periphery of the fitment. Likewise, such a fitment can be used with a simple flanged bottle neck finish to provide the lifting cam surface for the otherwise simple extrusion-blow molded container.

When the closure is attached directly to a container neck, the lid can have a plug which engages the neck to seal the opening when the lid is in its closed position. The plug can be proportioned to engage the external or the internal surface of the neck. If the plug engages the external surface of the container neck, it can have an inwardly directed bead which snaps over an outwardly directed flange on the container neck. The lifting action of the lid cam element will snap the lid bead open past the container flange.

In one embodiment, the lid bead is segmented so that at least one segment acts as the lid cam element. The sawtooth or undulating cam surface on the container neck is replaced with a single cam surface or spaced cam surfaces on the container neck. The cam surface would have a compound contour so that as the closure ring is rotated, the bead segment acting as a cam element on the lid will not only be cammed upwardly but also will be deflected outwardly to snap the lid bead open over the container neck flange. The bead segment cam element is, in effect, "plowed off" the container neck flange by the compound contour of the container neck cam surface.

The very nature of the lid release mechanism allows the closure to be readily fitted with child resistant and tamper indicating features. A child resistant feature can assume the form of a locking element which prevents rotation of the closure ring until the element is unlocked. This can be implemented by using a locking tab or tabs on the closure ring which cooperate with a stop or stops on the container neck or fitment to prevent rotation of the ring until a squeezing pressure is applied to the ring. In one embodiment the squeezing pressure is applied at the tabs to provide a radially inward movement of the tabs to cause the lock release. In another embodiment, the pressure can be applied at 90 degrees from the tabs to cause the lock release.

Likewise a tamper indicating feature can be added to the closure which indicates tampering or initial opening of the closure. This can be provided by a connection between the lid and the ring which must be severed to permit swinging of the lid from its closed position to its open dispensing position. The severence of the connection provides the evidence of initial opening or tampering of the lid. This tamper indicating connection can take the form of a tear band between the lid and the ring which must be removed before the lid can be opened. The tamper indicating connection can also take the form of a frangible web or webs between the lid and ring which is broken upon initial opening of the lid.

In the preferred form of the invention, the lid fits within the inner periphery of the ring. This allows the lid and ring to be molded in a closed position with a living hinge molded between the ring and lid. This provides a great saving in mold space as typically the lid and base member must be molded in a position in which the lid is open 180 degrees from the base member.

Tamper indication can be provided by a single web or a series of webs which extend radially between the lid and ring which are severed upon initial rotation and lifting movement of the lid relative to the ring.

The container neck can be fitted with an orifice or a nozzle adapter to reduce the size of the dispensing orifice or to produce a pouring spout for the container. The orifice or nozzle opening in the adapter can be closed by a plug on the lid when the lid is in its closed position. Also this plug can serve to carry the adapter within the closure before the closure is attached or "capped" on the container.

When a fitment is used in the case of a simple container neck finish or for application to a can top, the plug on the container neck can engage an opening on the fitment in the same fashion as the lid plug engages a container neck opening.

It will be readily apparent that other modifications can be made to the closure or the closure-container package that fall within the spirit of this invention which utilizes a cam opening lid which is hinged to a container ring.

The objectives of this invention are accomplished by the embodiments disclosed in the following description and illustrated in the drawing in which:

FIG. 1 is a perspective view of the closure of this invention attached to a container neck with the lid in a closed position before initial opening which will fracture frangible webs between the lid and base ring of the closure; the relationship of the cam element on the closure lid and a cam surface on the container neck is shown in phantom to indicate the lid lifting mechanism which will be actuated upon rotation of the base ring of the closure;

FIG. 2 is an exploded perspective view of the embodiment of the invention of FIG. 1 showing the lid in an open position after initial opening and fracture of the frangible tamper indicating webs, and showing the use of an intermediate orifice adapter for reducing the dispensing area of the container neck; the details of the cam element on the lid and the cam surface on the container neck are shown in full view;

FIG. 3 is an enlarged elevational view, partially in section taken along line 3—3 of FIG. 1, showing the closure of FIGS. 1 and 2 applied directly to a container neck with an orifice adapter seated within the container neck; this view clearly shows the permanent or not easily removed attachment of the closure to the container by a cooperating snap bead and flange connection and a lid retention bead and flange connection to the container neck as well as the sealing of the dispensing orifice by a plug depending from the lid.

FIG. 4 is a sectional view taken along line 4—4 of FIG. 3 showing the cam element on the lid prior to its engagement with the cam surface on the container neck as the closure ring is being rotated clockwise in the direction of the arrow;

FIG. 5 is a partial sectional view similar to FIG. 4 showing engagement of the cam element on the closure lid with the cam surface on the container neck as it has already effected an opening movement of the lid with respect to the closure base ring;

FIG. 6 is a sectional elevational view of the closure of FIGS. 1–5 taken along line 6—6 in FIG. 5 showing the lid having been opened by the coaction of the lid cam element and the container cam surface breaking a tamper indicating web between the lid and closure base ring and overcoming the retention of the lid bead and container neck flange;

Figure 1:
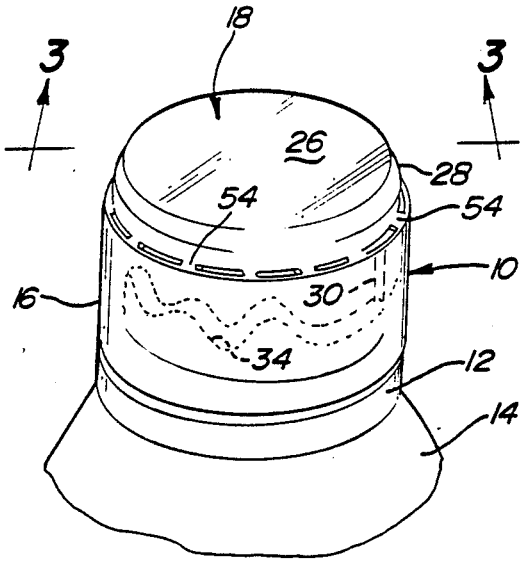
Figure 2:
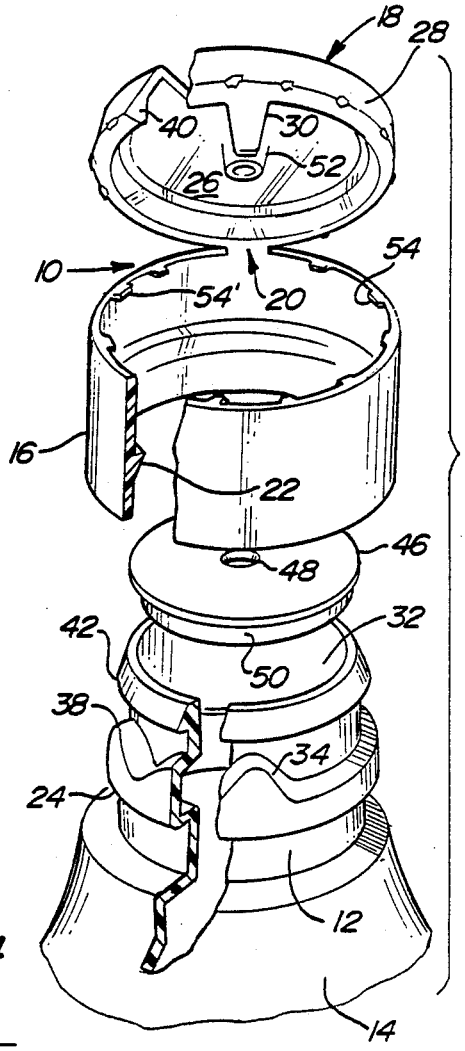
Figure 3:
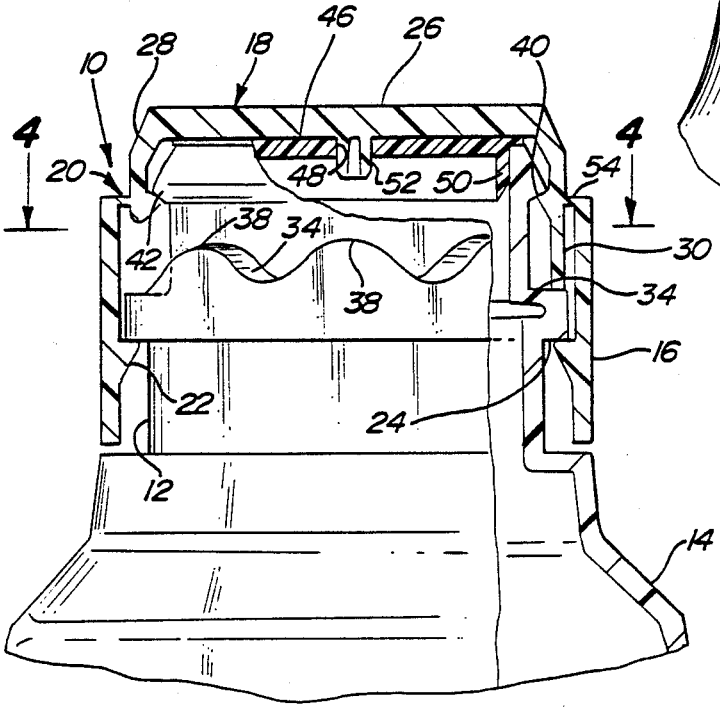
Figure 11:
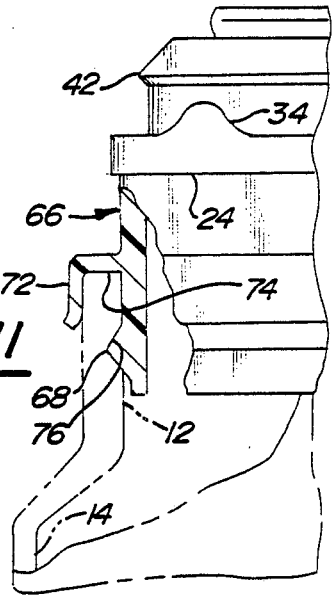
Figure 10:
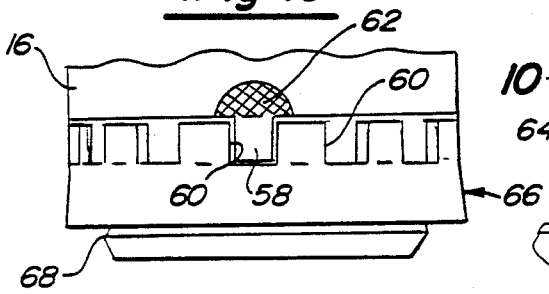
Figure 9:
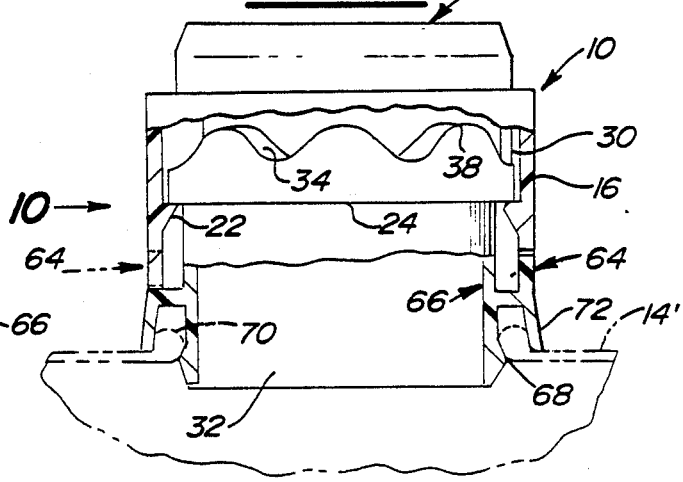
Figure 12:
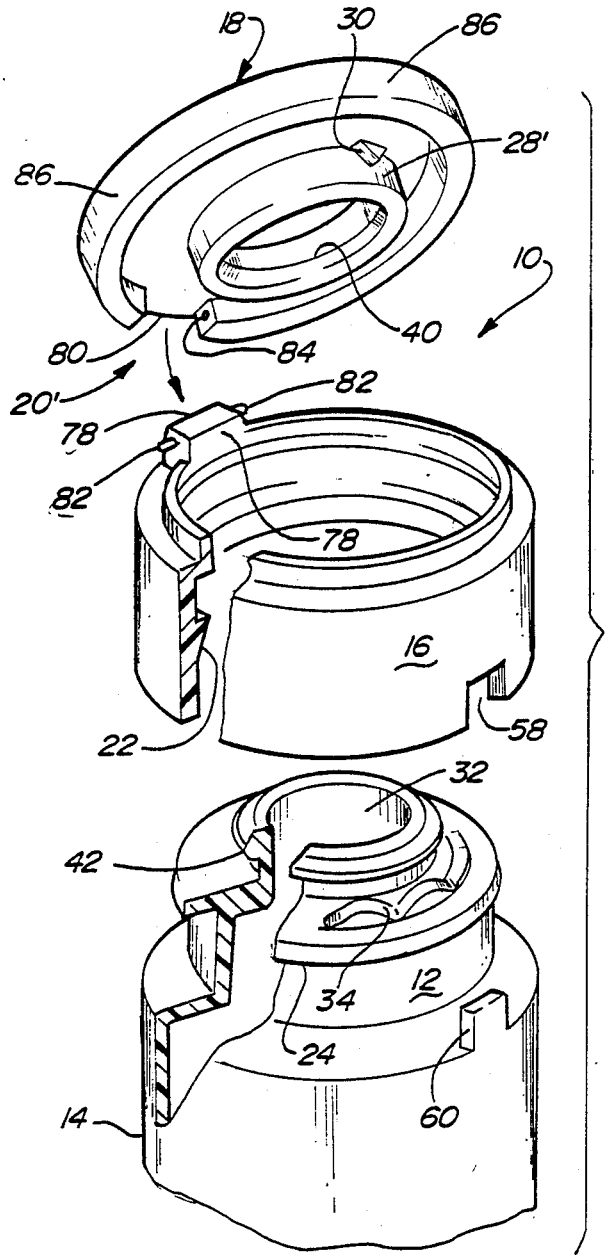
Figure 13:
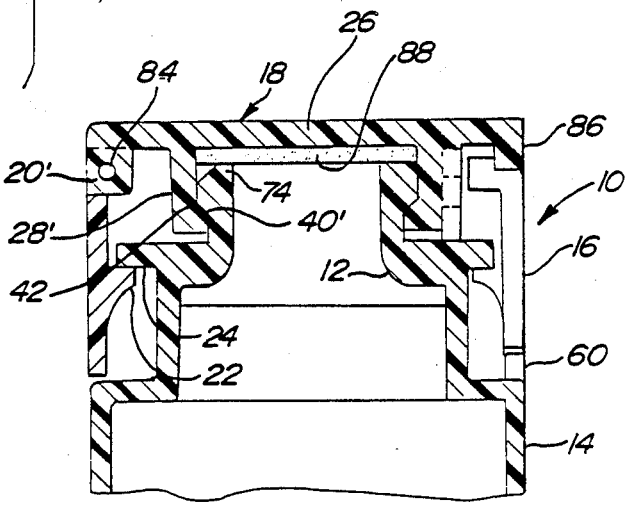
Figure 15:
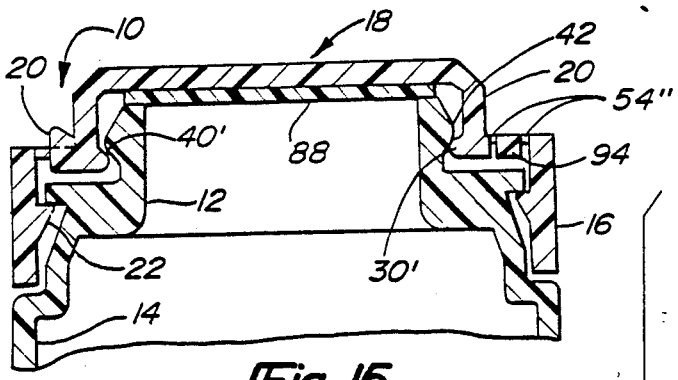
Figure 16:
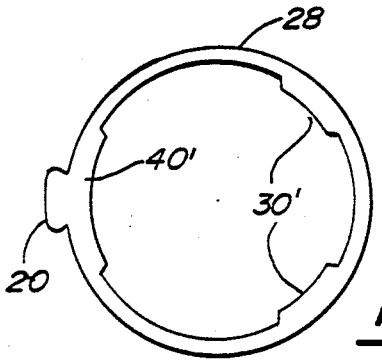
Figure 14:
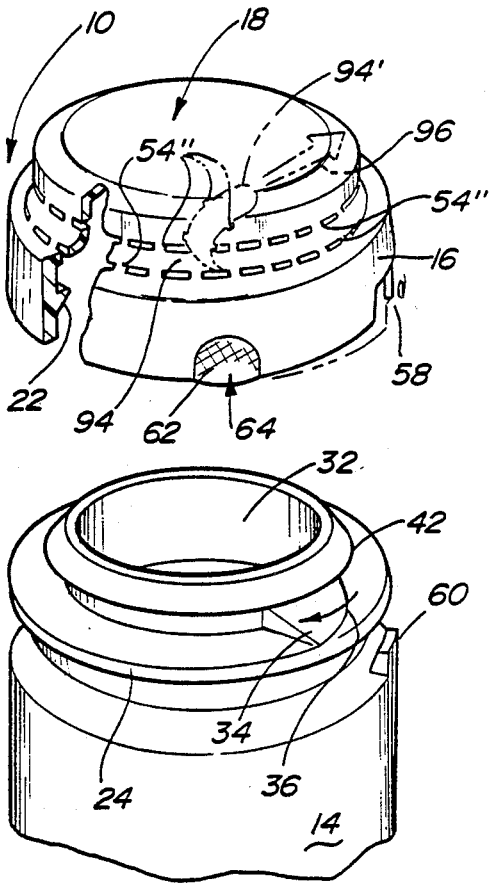
Figure 17:
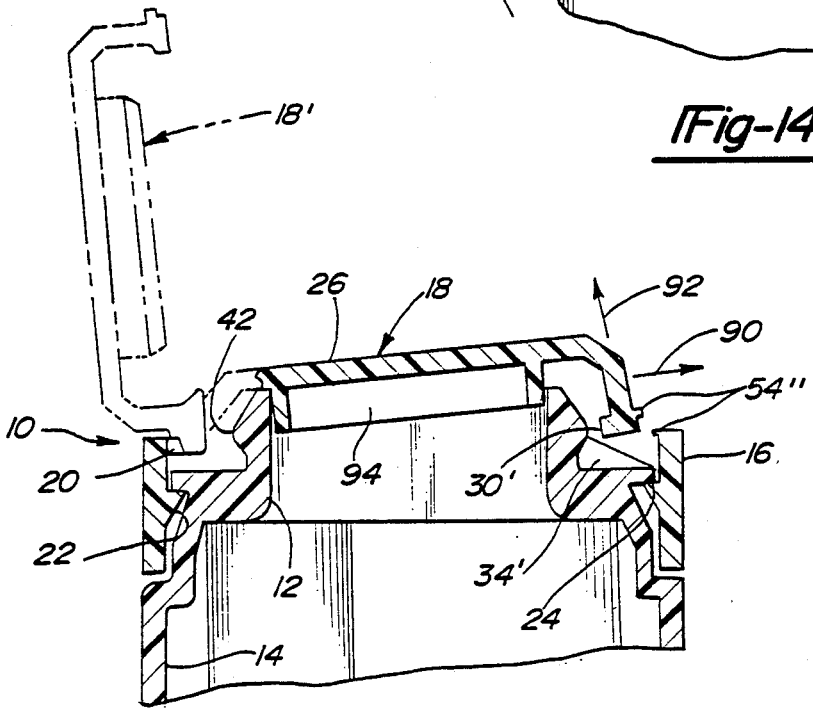

FIG. 9 is an elevational view similar to FIG. 3 with parts broken away and sectioned to show another embodiment of the invention in which the closure is applied to a fitment inserted into the top of a can; the closure ring has depending child resistant lugs which engage slot stops on the fitment surface to prevent rotation of the closure ring without simultaneous squeezing of the closure ring as it is being rotated;

FIG. 10 is a partial elevational view of the closure of FIG. 9 taken in the direction of the arrow 10 in FIG. 9 and showing one of the tamper indicating lugs on the closure base ring in engagement with one of the stop slots in the fitment body;

FIG. 11 is a partial elevational view with a portion broken away showing another embodiment of the invention similar to the embodiments of FIGS. 9–10 wherein the fitment is affixed to a container neck;

FIG. 12 is an exploded perspective view of the closure of this invention similar to FIG. 2 showing the lid connected to the closure base ring by a take apart post and slot hinge and further showing another embodiment of a child resistant lock between the closure base ring and the container body;

FIG. 13 is a sectioned elevational view of the closure of FIG. 12 showing the closure lid in a closed position with a sealing gasket interposed between the container neck finish and the closure lid;

FIG. 14 is an exploded perspective view similar to FIGS. 2 and 12 of another embodiment of the invention showing the application of a tamper indicating tear strip to the closure and a child resistant lock between the closure and the container neck; a different embodiment of the cam surface on the container neck is shown for cooperation with another embodiment of the cam element on the closure lid as more fully shown in FIGS. 15–17;

FIG. 15 is a cross-sectional elevational view of the closure shown in FIG. 14 affixed to a container flange with the lid in its closed position and secured by a tamper indicating tear strip having frangible webs between the strip and cap lid, and between the strip and closure base ring;

FIG. 16 is a bottom view of the lid of FIGS. 14, 15, and 17 showing the cam element as radially inwardly directed projections or individual segments of a segmented bead which secures the lid to the container neck or a fitment when the lid is in its closed position; and FIG. 17 is a cross-sectioned elevational view of the closures of FIGS. 14–16 showing the lid cammed to an open position by the coaction of the cam surface on the container neck and the cam element-bead segment on the closure lid.

DETAILED DESCRIPTION OF THE PREFERRED EMBODIMENTS OF THE INVENTION

Referring to FIGS. 1–6, the closure 10 is shown attached or in a position to be attached to the neck 12 of container or bottle 14. Closure 10 includes a base ring 16 and a lid 18 joined thereto by a hinge 20. The hinge 20 is shown as a living hinge being molded integrally with the base ring 16 and lid 18. In the preferred embodiment shown in FIGS. 1–6, the lid 18 has a smaller diameter than the inner diameter of the base ring 16 so that the closure 10 can be molded with the lid in its closed position which results in a considerable saving in mold space over conventional molding of the lid in a 180° open position from the base cap or ring.

The base ring 16 has an inwardly directed bead 22 which snaps over container neck flange 24 to retain the ring 16 on the container neck 12 for rotation relative to the neck but confined axially. The lid 18 has a top 26, a depending peripheral skirt 28, and an opening cam element 30. In its closed position, the lid 18 blocks access to the container neck opening 32. In the embodiment of FIGS. 1–6, the lid opening cam element 30 is in the form of a depending cam follower which coacts with the undulating or sawtooth cam surface 34 on the container neck. When the base ring 30 is rotated in a clockwise direction as shown by arrow 36 in FIG. 4, the cam element 30 rides on the cam surface 24 following the surface upwardly as shown in FIG. 5 to a peak 38 in the sawtooth or undulating cam surface 24 as shown in FIGS. 2 and 3 thereby lifting the lid 18 upwardly as shown by arrow 44 in FIG. 6 so that it can be pushed into a completely open dispensing position.

The lid 18 has an inwardly directed bead or flange 40 at the bottom of lid skirt 28 which coacts with an outwardly directed flange 42 on the container neck to retain the lid in its closed position until the cam follower 30 lifts the lid snapping the bead free from the container flange as shown in FIG. 6 as the lid is moved upward in the direction of arrow 44.

An orifice adapter 46, best seen in FIGS. 2, 3 and 6, can be used to reduce the dispensing opening from the larger container neck opening 32 to a smaller size dispensing orifice 48 in the adapter. The adapter 48 takes the form of a plug with a peripheral skirt 50 which makes sealing contact with the interior of container neck 12. Plug 52 depending from the lid top 26 will sealingly engage the dispensing orifice 48 when the lid 18 is in its closed position. Orifice adapter 46 can be maintained within the closure 10 by the retention of the plug 52 in dispensing orifice 48 prior to the application of the closure to the container neck. After packaging of the container contents, the orifice adapter will be sealingly pushed into the container neck in the capping operation.

Closure 10 of FIGS. 1–6 can be provided with a tamper indicating feature by supplying frangible webs 54 between the lid skirt 28 and the base ring 16. These webs will fracture as shown at 54' in FIGS. 2 and 6 upon the initial opening rotation of base ring 16 and the upward movement of the lid 18 caused by the coaction of cam element 30 with cam surface 34. Appearance of these broken webs is an indication that tampering or initial opening has occurred. These webs also serve to keep the lid in a closed position from the time that the closure 10 is molded until it is applied to the container, and thereafter the lid wall will be held in a closed position by the coaction of lid bead 40 with container neck flange 42 and the retention created by the coaction of lid plug 52 with dispensing orifice 48.

Figure 7:
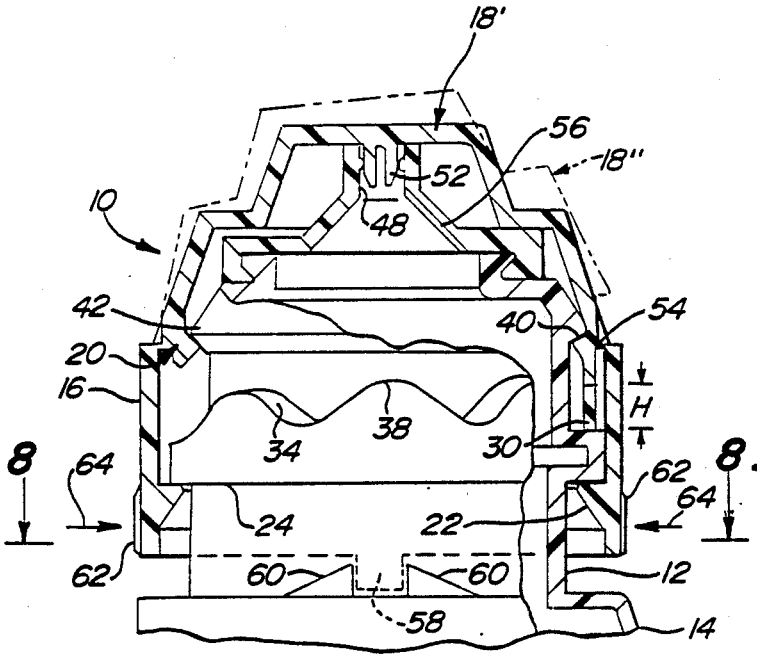
FIG. 7 is an elevational view partially in section showing another embodiment of the closure of this invention in which the closure lid has been modified to receive and accommodate a nozzle adapter snapped onto the container neck finish and showing a child resistant lock partially in phantom which prevents opening rotation of the closure ring without a simultaneous unlocking motion.
Figure 8:
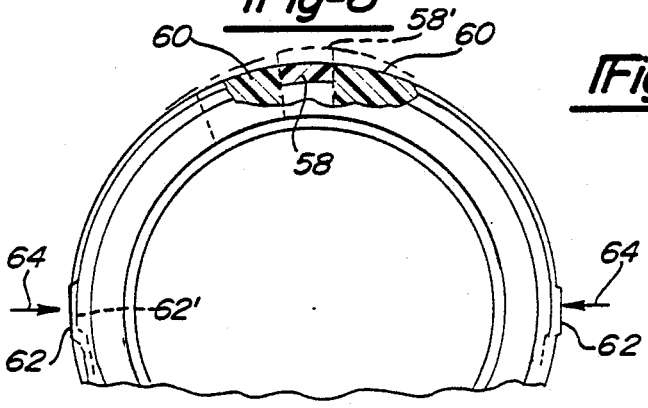
FIG. 8 is a fragmentary view taken along line 8—8 of FIG. 7 with a broken away sectional portion showing the engagement of the child resistant lug on the closure base ring with a stop on the container neck, and showing in phantom the released position of the child resistant lug when the closure ring has been squeezed as indicated by diametrically opposed arrows.

Referring to the embodiment shown in FIGS. 7 and 8, the closure 10 and its application to the container neck 12 is the same as that shown in the embodiment in FIGS. 1–6 except that the lid 18' has been configured with a higher profile to receive a nozzle adapter 56 in place of the orifice adapter 46. H in FIG. 7 indicates the distance the lid has been lifted by the movement of the cam element or follower 30 along the cam surface 34 to the peak of this surface at 38. The upwardly displaced position of the lid is shown in phantom at 18''. A child resistant feature has been added to this embodiment in the form of an axially extending lug or tab 58 which depends from the bottom of base ring 16 to coact with a container stop 60 to prevent rotation of the base ring in either direction. Release of the child resistant lock 58, 60 is obtained by pressing inwardly on the base ring 16 at diametrically opposed pad areas 62 in the directions of arrows 64 in FIG. 7 to deflect the tab 58 outwardly as shown at 58' in FIG. 8. It will be readily apparent that a pair of diametrically opposed tabs can be used with a pair of diametrically opposed stops 60. Each stop 60 includes a pair of axially extending surfaces to prevent rotation in either direction without squeezing the base ring inwardly.

In the embodiments of FIGS. 9–11, a fitment 66 is employed to adapt the closure 10 for use on a container finish that is not readily adapted to provide the necessary cooperating cam surfaces, child resistant stops and plural flanges for coaction with the closure base ring and lid beads. The fitment provides the necessary cam surface flanges and stops. For example, in FIG. 9 the fitment 66 is inserted into the opening 32 in the top of a can surface 14'. Outwardly directed bead 68 at the bottom of fitment 66 snaps over the rollover flange 70 on the can top which defines the container opening 32. Outer fitment skirt 72 engages the outer surface of the can flange 70.

FIG. 11 shows this same fitment 66 engaging the container neck lip 74 of a bottle type container 12 with the outwardly directed bead 68 of the fitment engaging a simple groove 76 in the interior surface of a neck 12. Outer fitment skirt 72 engages the outer surface of the neck 12. It will be appreciated that the fitment 66 can be modified to have a simple inwardly directed bead which engages an outwardly directed flange on the container neck for attachment of the fitment to a simple extruded bottle finish. The showing in FIG. 11 is without the closure 10 attached so that the full configuration of the fitment can be observed. In the adaptation of this fitment 66 to the can top 14' in FIG. 9, the closure 10 has been shown with the lid in its closed position. All of the other features such as the cam surface 34 and the base ring attaching bead 22 are as described in the previous FIGS. Also the lid cam element and the fitment cam surface can take other forms such as that shown and described in FIGS. 14–17.

In the partial elevational view of FIG. 10 depending tab or lug 58 depicted in FIGS. 7 and 8 has been shown for cooperative locking engagement with one of a plurality of lock stops 60 on the fitment body for release by exerting finger pressure on the pressure pads 62 in the direction of arrows 64 shown in FIG. 9.

The location of the pressure pads 64 indicate to the user where the cap's ring is to be squeezed to release the child resistant lock in the opening process. For example, the locking tabs 58 in the FIGS. 7 and 8 embodiments are designed to be deflected outwardly by the application of finger pressure at the pressure pads 62 in the direction of arrows 64. The pressure pads 62 are displaced 90 degrees from the locking tabs 58 to distort the locking tabs 58 outwardly to the position 58' to pass the container stops 60. In the embodiment of FIGS. 9 and 10, the locking tabs 58 are designed to be deflected inwardly of the fitment stops 60 so that pressure is applied in the direction of arrows 64 to the pressure pads 62 which are directly above the locking tabs 58.

In the embodiment of FIGS. 12 and 13, the closure 10 is a two piece closure with the base ring 16 being molded separately from the lid 18 and joined together at the take apart hinge 20'. This hinge is shown as having a single post 78 projecting upwardly from the cap or base ring 16 to be received in slot 80 in outer lid skirt 86. Curvilinear or cylindrical projections 82 on post 78 engage inline curvilinear or cylindrical recesses 84 in the slot 80 side walls of the outer lid skirt 86. The hinge 20' pivots about the center line of projections 82 and recesses 84. The recess and post can be reversed so that the post is on the lid and the recess is in an upstanding portion of the base ring 16. Likewise the projections and recesses can be interchanged as long as they are complimentary to each other in the mating parts. The lid and base ring hinge can also have a two post and slot structure as set forth in U.S. Pat. No. 4,666,068. In either hinge embodiment, the outer lid skirt 86 is flush with the outer periphery of the base ring 16 when the lid is in its closed position as shown in FIG. 13. In this closed position, the inner skirt or plug 28' engages the external surface of the container neck 12 to seal the container neck opening 32, and the inwardly directed bead or flange 40' which engages the outwardly projecting flange 42 on the container neck finish is located at the bottom of lid inner skirt 28' to perform the same retention function as the inwardly directed bead or flange 40 at the bottom of the single lid skirt 28 coacting with the outwardly directed flange 42 on the container neck in the embodiment of FIGS. 1–6. A further modification is shown in the child resistant latch 58, 60 wherein the stop 58 on the base ring 16 is in the form of a slot 58 which engages an axially extending stop tab 60 on the container finish. Like the child resistant latches 58, 60 of the embodiment of FIGS. 7 and 8 or FIGS. 9 and 10, the base ring must be squeezed to release the latch in order to rotate the base ring 15 to effectuate opening of the lid 18 by the coaction of lid cam element 30 with the container cam surface 34. FIG. 13 also shows the use of a sealing gasket 88 within inner skirt or plug 28' that seals between container neck lip 74 and the lid top 26. This gasket 88 can also be an oxygen barrier if desired.

In the embodiments of FIGS. 14–17, the lid cam element 30' and a cooperating container neck cam surface 34' have been modified over the previous embodiments. The inwardly directed lid retaining bead 40 of the prior embodiments is normally made as a peripherally continuous bead. In the embodiments of FIGS. 14–17, this bead has been made in segmented form as shown at 40' and 30' so that at least one segment 30' acts as the lid cam element. The cam surface 34' on the container neck has a compound curvature as shown in FIG. 14 so that as the base ring 16 is rotated in the direction of arrow 36 in FIG. 14 the segmented bead-cam element 30' will be plowed outwardly and upwardly as shown by arrows 90 and 92 respectively in FIG. 17. The other bead segments 30', 40' will be released simultaneously, or will be released when upward pressure is exerted to open the lid to its fully open dispensing position as shown at 18' in FIG. 17. As most clearly shown in FIGS. 14 and 15, a tamper indicating feature has been added to closure 10 in the form of a tear strip 94 which must be pulled upward as shown at 94' in the direction of arrow 96 in order to fracture the frangible webs 54'' so that the lid will open when the base ring is turned. A child resistant lock 58, 60 of the type shown in FIGS. 12 and 13 is also applied to the closure 10 as shown by the slot stop 58 in base ring 16 which engages the container stop tab 60 so that inward pressure must be applied in the direction of arrow 64 to pressure tab 62 to deflect the lid outwardly to disengage the tab 60 from slot 58.

It will be apparent from the numerous embodiments of the invention shown that the novel lid lifting dispensing closure 10 of the invention can be made with variations in the camming elements which cause the lid to initially open upon rotation of the base ring. Also the closure can be made with or without child resistant and tamper indicating features, and it can be made with a fitment so that the closure can be applied to various container configurations such as can tops and bottle necks with standard finishes.

A gasket sealing element 88 is shown in use in the FIG. 15 embodiment similar to the gasket seal 88 shown in FIG. 13. In FIG. 17, the gasket seal 88 has been replaced by a plug 94 on the top 26 of lid 18 which sealingly engages the interior of container neck 12.

It is intended that the cam surface 34' with a compound contour can be formed on a fitment 66 of the type shown in FIGS. 9–11 when the fitment is used with a closure having a bead segment cam element 30' on the closure lid.

The objectives of this invention are accomplished by the embodiments enclosed in the following description and illustrated in the drawing in which:

I claim:

1. A dispensing closure for attachment to a container for dispensing a product through an opening in the container comprising:

a base ring having means for attachment to said container permitting rotation without axial movement relative to said container;

a lid;

a hinge connecting said lid to said base ring allowing the lid to be swung between a closed position blocking access to said container opening and an open dispensing position; and a cam element on said lid arranged so that when the base ring is rotated, the lid will be moved from its closed position toward its open position so that the lid can be swung to its open dispensing position.

2. The dispensing closure according to claim 1 further including a locking element on said ring arranged so that pressure must be selectively applied to said ring to release said locking element for rotation of said ring.

3. The dispensing closure according to claim 1 further including a tamper indicating connection between said lid and ring which must be severed to permit swinging of said lid from its closed to its open dispensing position, the severence of said connection providing evidence of initial opening of said lid.

4. The dispensing closure according to claim 3 wherein said tamper indicating connection includes a tear band between said lid and said ring which must be removed before the lid can be opened.

5. The dispensing closure according to claim 3 wherein said tamper indicating connection includes a frangible web between said lid and ring which is broken upon initial opening of said lid.

6. The dispensing closure according to claim 1 wherein said cam element engages a cam surface on said container providing opening movement of said lid upon rotation of said ring.

7. The dispensing closure according to claim 1 wherein said lid has a flat top and a skirt depending from the periphery thereof, and further including an inwardly directed bead at the bottom of said lid skirt which cooperates with an outwardly directed flange on said container for snap-on retention of said lid on said container when said lid is in its closed position.

8. The dispensing closure according to claim 7 wherein said cam element effects pushing at least a portion of said bead over said flange when said ring is rotated and said lid is moved toward its open position.

9. The dispensing closure according to claim 8 wherein said lid bead is segmented and at least one of said bead segments forms said cam element which contacts a cam surface on said container to raise and outwardly extend said cam element bead segment when said ring is rotated snapping said cam element bead segment over said container flange so that said lid may be pushed to an open dispensing position.

10. The dispensing closure according to claim 1 wherein said container has a neck containing said opening, and said lid has a plug which engages said neck to seal said opening when said lid is in its closed position.

11. The dispensing closure according to claim 10 wherein said plug is proportioned to engage the external surface of said neck.

12. The dispensing closure according to claim 11 further including a gasket within said plug which seals against a lip of said container neck when said lid is in its closed position.

13. The dispensing closure according to claim 10 wherein said plug is proportioned to engage the internal surface of said neck.

14. The dispensing closure according to claim 10 further including an orifice adapter which engages said container neck to provide a dispensing orifice of smaller diameter than said opening.

15. The dispensing closure according to claim 14 wherein said plug engages said dispensing orifice to retain said orifice adapter within said closure prior to attaching said closure to said container, and when said closure is attached to said container, said plug sealingly engages said dispensing orifice when said lid is in its closed position.

16. The dispensing closure according to claim 1 wherein said container has a neck terminating in a lip defining said opening and further including a gasket within said lid which seals against said lip when said lid is in its closed position.

17. The dispensing closure according to claim 1 wherein said means for attachment includes an inwardly directed bead on said ring which snaps over an outwardly directed flange on said container neck.

18. The dispensing closure according to claim 1 further including a fitment which attaches to said container in communication with said opening, and said ring is attached to said fitment for rotation relative to said fitment.

19. The dispensing closure according to claim 18 wherein said ring has an inwardly directed bead which snaps over an outwardly directed flange on said fitment for attaching said ring to said fitment.

20. The dispensing closure according to claim 18 wherein said container is a can and said fitment has means for engagement within said opening in the top of said can.

21. The dispensing closure according to claim 18 wherein said container is a bottle having a neck and said fitment has a head for snap-on attachment to said neck.

22. The dispensing closure according to claim 18 wherein said fitment has a cam surface so that when said ring is rotated, said cam element will contact said cam surface and move said lid from its closed position towards its open position so that the lid be swung to its open dispensing position.

23. The dispensing closure according to claim 22 wherein said cam surface has a sawtoothed configuration and said cam element is configured as a depending cam follower so that when said ring is rotated said cam follower will contact said sawtoothed cam surface and raise said lid from its closed position towards its open position.

24. The dispensing closure according to claim 22 wherein said lid has a flat top and skirt depending from the periphery thereof and further including and inwardly directed bead at the bottom of said lid skirt which cooperates with an outwardly directed flange on said fitment for snap-on retention of said lid on said fitment when said lid is in its closed position.

25. The dispensing closure according to claim 24 wherein said cam element effects pushing at least a portion of said bead over said flange when said ring is rotated and said lid is moved towards its open position.

26. The dispensing closure according to claim 25 wherein said lid bead is segmented and at least one of said bead segments forms said cam element which contacts a cam surface on said fitment to raise and outwardly deflect said cam element bead segment when said ring is rotated snapping said cam element bead segment over said container flange so that said lid can be pushed to an open dispensing position.

27. The dispensing closure according to claim 1 wherein said lid has a smaller diameter than the diameter of said base ring and said lid fits within a portion of said base ring when said lid is in its closed position.

28. The dispensing closure having a fitment for attachment to a container for dispensing a product through an opening in the container comprising:

a fitment having means for attachment to said container and a cam surface;

a base ring having means for attachment to said fitment permitting rotation without axial movement relative to said fitment;

a lid;

a hinge connecting said lid to said base ring allowing the lid to be swung between a closed position blocking access to said container opening and an open dispensing position; and a cam element on said lid arranged so that when said ring is rotated said cam element will contact said cam surface and move said lid from its closed position towards its open position so that the lid cam be swung to its open dispensing position.

29. The dispensing closure according to claim 28 wherein said container has a neck and said means for attachment includes a bead for a snap-on connection to said container neck.

30. The dispensing closure according to claim 28 wherein said container is a can having a flat top with an opening therein, and said attachment means includes an outwardly directed bead on said fitment for snap-on connection within the opening on said can.

31. A dispensing closure-container package for dispensing a product through an opening in the container comprising, in combination:

a container having means for receiving a closure and a cam surface for use in lifting a lid of said closure;

a closure having the following:

a base ring having means for attachment to said container permitting rotation without axial movement relative to said container;

a lid;

a hinge connecting said lid to said base ring allowing the lid to be swung between a closed position blocking access to said container opening and an open dispensing position; and a cam element on said lid arranged so that when said ring is rotated said cam element will contact said container cam surface and move said lid from its closed position towards its open position so that the lid can be swung to its open dispensing position.

32. The dispensing closure according to claim 31 wherein said cam surface has a sawtoothed configuration and said cam element is configured as a depending cam follower so that when said ring is rotated said cam follower will contact said sawtoothed cam surface and raise said lid from its closed position towards its open position.

33. The dispensing closure according to claim 32 wherein said lid has a flat top and a skirt depending from the periphery therefrom and further including an inwardly directed bead at the bottom of said lid skirt which cooperates with an outwardly directed flange on said container for snap-on retention of said lid on said container when said lid is in its closed position.

34. The dispensing closure according to claim 33 wherein said cam element effects pushing at least a portion of said bead over said flange when said ring is rotated and said lid is moved towards its open position.

35. The dispensing closure according to claim 34 wherein said lid bead is segmented and at least one of said bead segments forms said cam element which contacts a cam surface on said container to raise and outwardly deflect said cam element bead segment when said ring is rotated snapping said cam element bead segment over said container flange so that said lid may be pushed to an open dispensing position.

36. A dispensing closure-container package for dispensing a product through an opening in the container comprising, in combination:

a container having means for receiving a fitment circumposing said opening;

a fitment having means for attachment to said container in communication with said opening, said fitment having a cam surface;

a closure having the following:

a base ring having means for attachment to said fitment permitting rotation without axial movement relative to said fitment;

a lid;

a hinge connecting said lid to said base ring allowing the lid to be swung between a closed position blocking access to said container opening and an open dispensing position; and a cam element on said lid arranged so that when said lid is rotated said cam element will contact said fitment cam surface and move said lid from its closed position towards its open position so that the lid can be swung to its open dispensing position.

* * * * *